US005590545A

United States Patent [19]

Norris

[11] Patent Number: 5,590,545

[45] Date of Patent: Jan. 7, 1997

[54] GARMENT STRAP RETAINER

[76] Inventor: J. Bernice Norris, 5102 Walnut Grove Rd., Memphis, Tenn. 38117

[21] Appl. No.: 221,522

[22] Filed: Apr. 1, 1994

[51] Int. Cl.[6] ..... A44C 25/00; A41F 1/00

[52] U.S. Cl. ..... 63/2; 24/563; 2/323

[58] Field of Search ..... 2/323, 336, 2; 63/2; 24/563

[56] References Cited

U.S. PATENT DOCUMENTS

| | | | |
|---|---|---|---|
| 1,489,731 | 4/1924 | Baldwin . | |
| 1,544,303 | 6/1925 | Fellows . | |
| 1,589,228 | 6/1926 | Robb . | |
| 1,593,776 | 7/1926 | Raymond . | |
| 1,641,004 | 8/1927 | Mahoney . | |
| 1,778,428 | 10/1930 | Morehouse | 24/563 |
| 2,015,113 | 9/1935 | Johnson | 2/323 |
| 2,046,589 | 7/1936 | Stader . | |
| 2,049,660 | 8/1936 | Patten | 24/563 |
| 2,184,249 | 12/1939 | Churchill | 24/563 |
| 2,444,806 | 7/1948 | Cleasby . | |
| 2,654,132 | 10/1953 | Norcross | 2/323 |
| 4,414,716 | 11/1983 | Stastney | 24/563 |
| 4,540,349 | 9/1985 | Young | 24/563 |
| 4,833,751 | 5/1989 | Iwase et al. | 24/563 |
| 4,914,791 | 4/1990 | Lorber | 24/563 |
| 4,915,279 | 4/1990 | Galbraith | 24/563 |
| 5,231,735 | 8/1993 | Paxton | 24/563 |

*Primary Examiner*—Michael J. Milano

*Attorney, Agent, or Firm*—Walker, McKenzie & Walker, P.C.

[57] ABSTRACT

A retainer for gathering together a shoulder strap of a first garment and a shoulder strap of a second garment and for holding one or more shoulder straps in place on a wearer's shoulder. The retainer includes a body having stabilizing structure for holding the retainer stable on the wearer's shoulder; and grip structure attached to the body for gripping one or more shoulder straps and for securing one or more shoulder straps to the body.

1 Claim, 2 Drawing Sheets

GARMENT STRAP RETAINER

BACKGROUND OF THE INVENTION

1. Field of the Invention

The present invention relates, in general, to a retainer for holding one or more garment shoulder straps in place.

2. Information Disclosure Statement

A preliminary patentability search in class 2, subclasses 336 and 337, and class 24, subclasses 182, 519, 563 and 532, produced the following patents which may be material to the present invention:

Baldwin, U.S. Pat. No. 1,489,731, issued Apr. 8, 1924, discloses a shoulder strap holder adapted to be stitched or otherwise secured to the underside of a gown, dress or blouse at the shoulder in such a manner as the straps of any or all undergarments worn with or under such gown, dress or blouse can be inserted within the holder and securely held in place in such a position that the shoulder straps will not become exposed by reason of the fact that the gown, dress or blouse slips or shifts to different positions on the wearer's shoulders.

Fellows, U.S. Pat. No. 1,544,303, issued Jun. 30, 1925, discloses a lingerie clasp assembly including a spring-type clasp for receiving the shoulder straps of an undergarment, and a snap member for being sewed to an outer garment to hold the clasp in place on the outer garment.

Robb, U.S. Pat. No. 1,589,228, issued Jun. 15, 1926, discloses a lingerie clasp for being sewed to the inner face of the shoulder portion of a dress to retain straps of lingerie or under garments on the shoulders of the wearer and concealed under the dress.

Raymond, U.S. Pat. No. 1,593,776, issued Jul. 27, 1926, discloses a lingerie clasp for being anchored firmly to a dress having arms that can be sprung apart to receive the shoulder straps of lingerie.

Mahoney, U.S. Pat. No. 1,641,004, issued Aug. 30, 1927, discloses a shoulder strap holder for armpits shields to retain the straps of lingerie, brassieres, etc., on the shoulders of the wearer while the arm pit shield is attached to the holder to prevent the arm pit shield from being worked out of position.

Stader, U.S. Pat. No. 2,046,589, issued Jul. 7, 1936, discloses a shoulder strap holder for being secured to an outer garment and for holding the shoulder straps of inner garments in place relative to the outer garment.

Patten, U.S. Pat. No. 2,049,660, issued Aug. 4, 1936, discloses a shoulder strap retaining device for being stitched to a first garment and for retaining shoulder straps of a second garment.

Cleasby, U.S. Pat. No. 2,444,806, issued Jul. 6, 1948, discloses a shoulder strap combination for brassieres and foundation garments including a lock device for allowing a support pad to being attached to the existing brassiere or foundation garment shoulder strap for comfort.

Nothing in the known prior art discloses or suggests the present invention. More specifically, nothing in the known prior art discloses or suggests a retainer for holding a shoulder strap of a first garment in place on a wearer's shoulder, including a body having stabilizing means for holding the retainer stable on the wearer's shoulder; and grip means attached to the body for gripping one or more shoulder straps and for securing one or more shoulder straps to the body.

SUMMARY OF THE INVENTION

The present invention provides a device for gathering and retaining garment straps and in particular lingerie straps. A basic concept of the present invention is to provide a device that solves the problem of straps separating, slipping and/or falling off the wearer's shoulders.

The retainer of the present invention comprises, in general, a body including stabilizing means for holding the retainer stable on the wearer's shoulder; and grip means attached to the body for gripping a shoulder strap of a first garment and for coacting with the body to hold one or more shoulder straps in a desired position relative on the wearer's shoulder.

One object of the present invention is to provide such a retainer that does not require holes, etc., to be punched or otherwise formed in the strap or straps being retained or in the wearer's clothing, etc.

Another object of the present invention is to provide such a retainer that does not include any structure that might rip the strap or straps being retained or the wearer's clothing when being placed or removed from the straps, etc.

Another object of the present invention is to provide such a retainer that does not rub or pinch the wearer's skin.

Another object of the present invention is to provide such a retainer that does not include any structure that might stick or prick the wearer or someone coming in contact with the wearer.

DESCRIPTION OF THE PREFERRED EMBODIMENT

Figure 1:
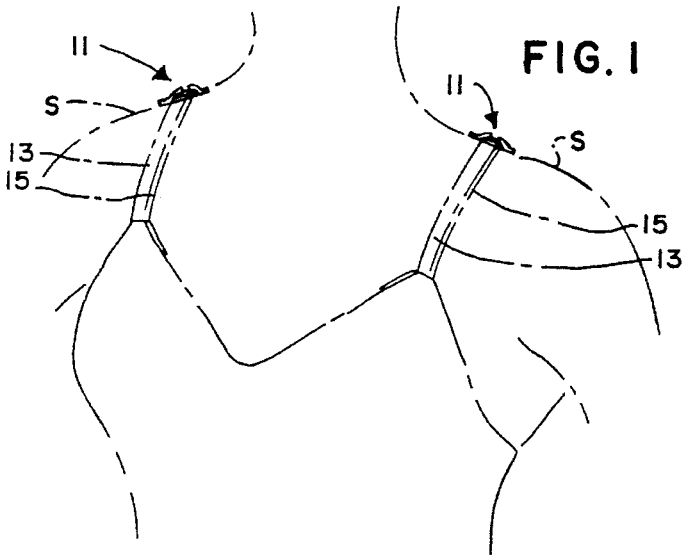
FIG. 1 is a somewhat diagrammatic view of a pair of garment straps retainer of a first embodiment of the present invention, shown holding one or more garment shoulder straps in place on a wearer's shoulders.

A first preferred embodiment of the garment strap retainer of the present invention is shown in FIGS. 1–5, and identified by the numeral 11. The retainer 11 is used to hold one or more garment shoulder straps in place on a wearer's shoulder S. As clearly shown in FIG. 1, the retainer 11 is used to hold a shoulder strap 13 of a first garment in place on a wearer's shoulder S. The retainer 11 may be used to gather together a shoulder strap 13 of a first garment and a shoulder strap 15 of a second garment and for retaining or holding the straps 13, 15 in place on a wearer's shoulder S as shown in FIG. 1. The garments may consist of items of lingerie that are frequently layered and that typically have thin, narrow shoulder straps such as brassieres and slips. However, the first or outer garment may also consist of outer garments such as evening dresses or the like having thin, narrow shoulder straps, etc., as will now be apparent to those skilled in the art.

The retainer 11 includes a body 17 preferably having a first end 19, a second end 21, and a substantially flat bottom portion 23 extending between the first and second ends 19, 21. The body 17 has stabilizing means 25 for holding the retainer 11 stable on the wearer's shoulder S. The stabilizing means 19 may be formed by relative wide areas or foot portions on the substantially flat bottom portion 23 of the opposite first and second ends 19, 21 of the body 17.

The retainer 11 includes grip means 27 attached to the body 17 for gripping one or more shoulder straps 13, 15 and for coacting with the body 17 to retain one or more shoulder straps 13, 15 together in a desired position on the wearer's shoulder S. The grip means 27 preferably includes first arm means 29 extending from the first end 19 of the body 17 toward the second end 21 thereof for coacting with the body 17 to form a cavity 31 for receiving one or more straps 13, 15. The grip means 27 preferably includes a second arm means 33 extending from the second end 21 of the body 17 toward the first end 19 thereof for coacting with the body 17 to form a cavity 35 for receiving one or more straps 13, 15. The grip means 27 preferably includes a third arm means 37 extending from the first end 19 of the body 17 toward the second end 21 thereof for coacting with the body 17 to form a cavity 39 for receiving one or more straps 13, 15. The grip means 27 preferably includes a fourth arm means 41 extending from the second end 21 of the body 17 toward the first end 19 thereof for coacting with the body 17 to form a cavity 43 for receiving one or more straps 13, 15.

Figure 2:
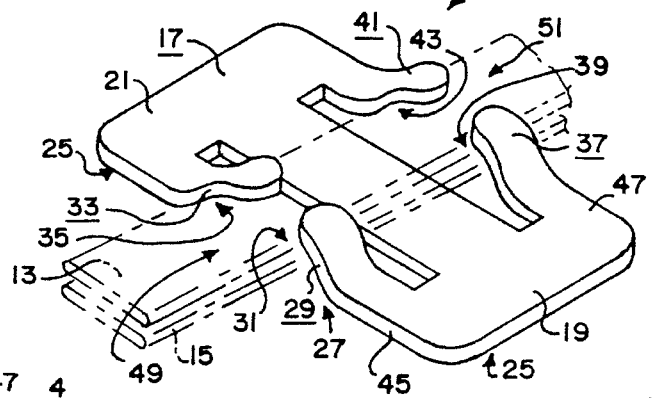
FIG. 2 is an enlarged perspective view of the first embodiment of the garment straps retainer of the present invention with a pair of garment straps shown in broken lines.
Figure 3:
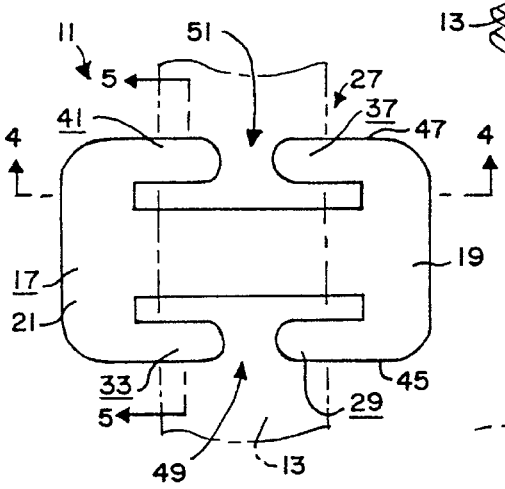
FIG. 3 is an enlarged top plan view of the first embodiment of the garment straps retainer of the present invention with a garment strap shown in broken lines.
Figure 4:
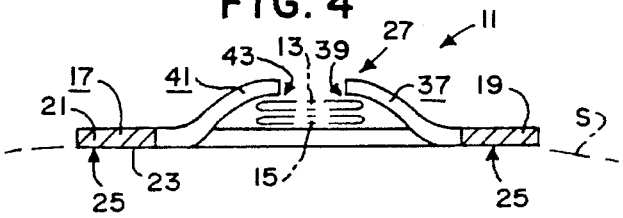
FIG. 4 is a sectional view substantially as taken on line 4—4 of FIG. 2.
Figure 5:
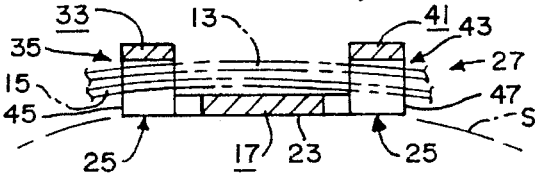
FIG. 5 is a sectional view substantially as taken on line 5—5 of FIG. 2.

The body 17 preferably has a first side 45 and a second side 47 with the first and second arm means 29, 33 located on the first side 45 and with the third and fourth arm means 37, 41 located on the second side 47 as clearly shown in FIGS. 2 and 3.

The first and second arm means 29, 33 are preferably aligned with one another with a gap 49 between the distal ends thereof as shown in FIGS. 2 and 3 large enough to allow one or more straps 13, 15 to be easily inserted therethrough into the cavities 31, 35 but small enough to hold one or more straps 13, 15 within the cavities 31, 35 until intentionally removed therefrom by manual manipulation as will now be apparent to those skilled in the art. Likewise, the third and fourth arm means 37, 41 are preferably aligned with one another with a gap 51 between the distal ends thereof as shown in FIGS. 2 and 3 large enough to allow one or more straps 13, 15 to be easily inserted therethrough into the cavities 39, 43 but small enough to hold one or more straps 13, 15 within the cavities 39, 43 until intentionally removed therefrom by manual manipulation as will now be apparent to those skilled in the art.

The retainer 11 can be manufactured in various manners and out of various materials as will now be apparent to those skilled in the art. For example, the body 17 and grip means 27 may be molded, stamped or machined as a one-piece, integral unit out of metal, plastic or synthetic resin such as nylon, etc., with all burrs, flash and sharp edges removed, and may be finished in various colors, patterns, etc. The retainer 11 may be dimpled, jeweled, engraved or otherwise finished in a pleasing, ornamental manner.

A second preferred embodiment of the garment strap retainer of the present invention is shown in FIGS. 6–9 and identified by the numeral 2.11. The retainer 2.11 is also used to hold at least one shoulder strap 13 of a first garment in place on a wearer's shoulder S, and may be used to gather together a shoulder strap 13 of a first garment and a shoulder strap 15 of a second garment and for retaining or holding the straps 13, 15 in place on a wearer's shoulder S in the same manner as shown in FIG. 1 with respect to the retainer 11.

The retainer 2.11 includes a body 2.17 preferably having a first end 2.19, a second end 2.21, and a substantially flat bottom portion 2.23 extending between the first and second ends 2.19, 2.21. The body 2.17 has stabilizing means 2.25 for holding the retainer 2.11 stable on the wearer's shoulder S. The stabilizing means 2.19 may be formed by relative wide areas on the substantially flat bottom portion 2.23 of the opposite first and second ends 2.19, 2.21 of the body 2.17. Preferably, the stabilizing means 2.19 is formed by the entire bottom portion 2.23 of the body 2.17.

The retainer 2.11 includes grip means 2.27 attached to the body 2.17 for gripping one or more shoulder straps 13, 15 and for coacting with the body 2.17 to retain one or more shoulder straps 13, 15 together in a desired position on the wearer's shoulder S. The grip means 2.27 preferably includes first arm means 2.29 extending from the first end 2.19 of the body 2.17 toward the second end 2.21 thereof for coacting with the body 2.17 to form a cavity 2.31 for receiving one or more straps 13, 15. The grip means 2.27 preferably includes a second arm means 2.33 extending from the second end 2.21 of the body 2.17 toward the first end 2.19 thereof for coacting with the body 2.17 to form a cavity 2.35 for receiving one or more straps 13, 15.

Figure 6:
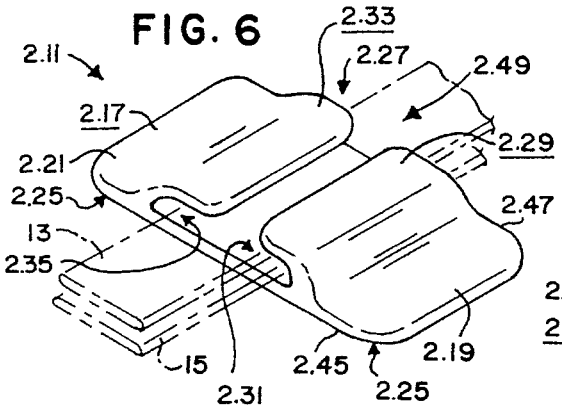
FIG. 6 is an enlarged perspective view of a second embodiment of the garment straps retainer of the present invention with a pair of garment straps shown in broken lines.
Figure 7:
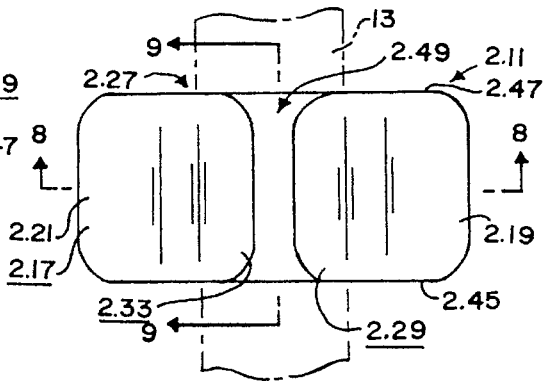
FIG. 7 is an enlarged top plan view of the second embodiment of the garment straps retainer of the present invention with a garment strap shown in broken lines.

The body 2.17 preferably has a first side 2.45 and a second side 2.17 with the first and second arm means 2.29, 2.33 extending completely from the first side 2.45 to the second side 2.47 as clearly shown in FIGS. 6 and 7.

Figure 8:
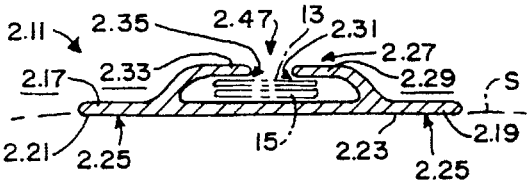
FIG. 8 is a sectional view substantially as taken on line 8—8 of FIG. 7.
Figure 9:
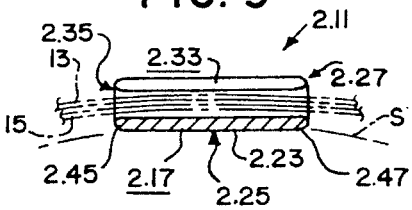
FIG. 9 is a sectional view substantially as taken on line 9—9 of FIG. 7.

The first and second arm means 2.29, 2.33 are preferably aligned with one another with a gap 2.49 between the distal ends thereof as shown in FIGS. 6,7 and 8 large enough to allow one or more straps 13, 15 to be easily inserted therethrough into the cavities 2.31, 2.35 but small enough to hold one or more straps 13, 15 within the cavities 2.31, 2.35 until intentionally removed therefrom by manual manipulation as will now be apparent to those skilled in the art.

The retainer 2.11 can be manufactured in various manners and out of various materials as will now be apparent to those skilled in the art. For example, the body 2.17 and grip means 2.27 may be molded, stamped or machined as a one-piece, integral unit out of metal, plastic or synthetic resin such as nylon, etc., with all burrs, flash and sharp edges removed, and may be finished in various colors, patterns, etc. The retainer 2,11 may be dimpled, jeweled, engraved or otherwise finished in a pleasing, ornamental manner.

A third preferred embodiment of the garment strap retainer of the present invention is shown in FIGS. 10–13 and identified by the numeral 3.11. The retainer 3.11 is also used to hold at least one shoulder strap 13 of a first garment in place on a wearer's shoulder S, and may be to gather together a shoulder strap 13 of a first garment and a shoulder strap 15 of a second garment and for retaining or holding one or more straps 13, 15 in place on a wearer's shoulder S in the same manner as shown in FIG. 1 with respect to the retainer 11.

The retainer 3.11 includes a body 3.17 preferably having a first end 3.19, a second end 3.21, and a bottom portion 3.23 extending partway between the first and second ends 3.19, 3.21. The body 3.17 has stabilizing means 3.25 for holding the retainer 3.11 stable on the wearer's shoulder S. The stabilizing means 3.19 may be formed by relative wide, flat areas on the bottom portion 3.23 of the opposite first and second ends 3.19, 3.21 of the body 3.17.

The retainer 3.11 includes grip means 3.27 attached to the body 3.17 for gripping one or more shoulder straps 13, 15 and for coacting with the body 3.17 to retain one or more shoulder straps 13, 15 together in a desired position on the wearer's shoulder S. The grip means 3.27 preferably includes first arm means 3.29 extending from the first end 3.19 of the body 3.17 toward the second end 3.21 thereof for coacting with the body 3.17 to form a cavity 3.31 for receiving the straps 13, 15. The grip means 3.27 preferably includes a second arm means 3.33 extending from the second end 3.21 of the body 3.17 toward the first end 3.19 thereof for coacting with the body 3.17 to form a cavity 3.35 for receiving one or more straps 13, 15. The arm means 3.29, 3.33 preferably form an extension of the substantially flat first and second ends 3.19, 3.21 of the body 3.17 and enhances the stabilizing means 3.25.

Figure 11:
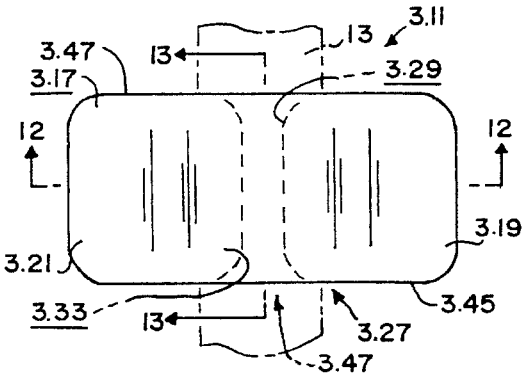
FIG. 11 is an enlarged top plan view of the third embodiment of the garment straps retainer of the present invention with a garment strap shown in broken lines.

The body 3.17 preferably has a first side 3.45 and a second side 3.17 with the first and second arm means 3.29, 3.33 extending completely from the first side 3.45 to the second side 3.47 as clearly indicated in FIG. 11.

Figure 10:
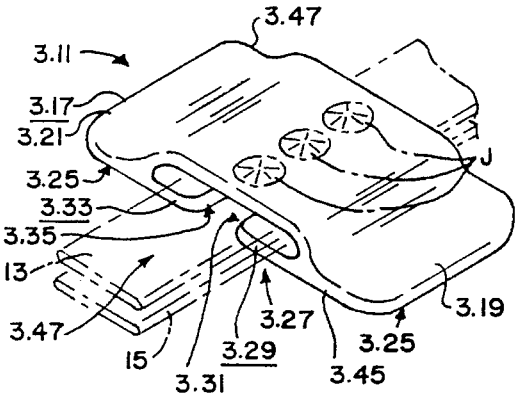
FIG. 10 is an enlarged perspective view of a third embodiment of the garment straps retainer of the present invention with a pair of garment straps shown in broken lines.
Figure 12:
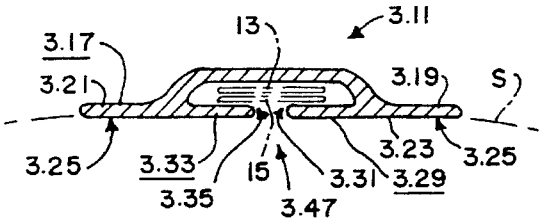
FIG. 12 is a sectional view substantially as taken on line 12—12 of FIG. 11.
Figure 13:
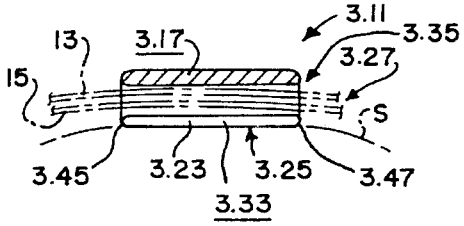
FIG. 13 is a sectional view substantially as taken on line 13—13 of FIG. 11.

The first and second arm means 3.29, 3.33 are preferably aligned with one another with a gap 3.49 between the distal ends thereof as shown in FIGS. 10, 11 and 12 large enough to allow one or more straps 13, 15 to be easily inserted therethrough into the cavities 3.31, 3.35 but small enough to hold one or more straps 13, 15 within the cavities 3.31, 3.35 until intentionally removed therefrom by manual manipulation as will now be apparent to those skilled in the art.

The retainer 3.11 can be manufactured in various manners and out of various materials as will now be apparent to those skilled in the art. For example, the body 3.17 and grip means 3.27 may be molded, stamped or machined as a one-piece, integral unit out of metal, plastic or synthetic resin such as nylon, etc., with all burrs, flash and sharp edges removed, and may be finished in various colors, patterns, etc. The retainer 3.11 may be dimpled, jeweled, engraved or otherwise finished in a pleasing, ornamental manner. Thus, for example, jewels J or the like may be set into the upper surface of the body 3.17 as shown diagrammatically in FIG. 10.

The operation and use of the present invention is quite simple. Each embodiment of the retainer is used in much the same way. One or more strap members are manually inserted through the gap between the opposing arm means into the cavity between the respective arm means and the body. The retainer can then be manually slid along the straps to rest on the wearer's shoulder. The arm means are not bent or mashed to pinch the straps. The retainer is not sewn or otherwise fixedly attached to the straps and can be easily manually slid along the straps to allow the wearer to position the retainer at any desired location on the wearer's shoulder. A critical feature of the retainer of the present invention is the stabilizing means which provide sufficient surface contact with the wearer's shoulder to hold the retainer stable on the wearer's shoulders.

It is to be understood that the form of this invention herewith shown and described are to be taken as preferred examples of the same, and that various changes in the shape, size and arrangement of parts may be resorted to without departing from the spirit of the invention of the scope of the subjoined claims.

I claim:

1. A retainer for holding a shoulder strap of a first garment in place on a wearer's shoulder, said retainer comprising:

(a) a body having a first end, a second end, and stabilizing means for contacting the wearer's shoulder and for holding said retainer stable on the wearer's shoulder; said stabilizing means including a first foot portion at said first end of said body and a second foot portion at said second end of said body; said first foot portion having a contact surface for contacting a first area of the wearer's shoulder; said second foot portion having a contact surface for contacting a second area of the wearer's shoulder; said contact surfaces of said first and second foot portions are coplanar with one another for simultaneously contacting the first and second areas, respectively, of the wearer's shoulder and for holding said retainer stable on the wearer's shoulder; and (b) grip means attached to said body adjacent said first and second ends of said body for gripping said shoulder strap and for securing said shoulder strap to said body; said grip means including a first arm means extending from body for forming a cavity between said body and said first arm means for receiving said shoulder strap; said grip means including a second arm means extending from said body for forming a cavity between said body and said second arm means for receiving said shoulder strap; said first arm means having a distal end; said second arm means having a distal end spaced apart from said distal end of said first arm means a distance to form a gap therebetween large enough to allow said shoulder strap to be inserted therethrough into said cavity between said body and said first arm means and said cavity between said body and said second arm means; said cavity formed between said first arm and said body for receiving said shoulder strap is located on a plane above said stabilizing means; and said cavity formed between said second arm and said body for receiving said shoulder strap is located on a plane above said stabilizing means.

* * * * *